United States Patent [19]

Cowell

[11] Patent Number: 4,594,072

[45] Date of Patent: Jun. 10, 1986

[54] INFANT'S SOFT, SIMULATED AUTO DASHBOARD

[75] Inventor: Robert L. Cowell, Manhattan Beach, Calif.

[73] Assignee: Mattel, Inc., Hawthorne, Calif.

[21] Appl. No.: 679,659

[22] Filed: Dec. 7, 1984

Related U.S. Application Data

[63] Continuation-in-part of Ser. No. 581,939, Feb. 21, 1984.

[51] Int. Cl.[4] ..... A63H 17/00; A63H 33/00

[52] U.S. Cl. ..... 446/227; 446/7; 446/486; D21/142

[58] Field of Search ..... 446/7, 227, 212, 218, 446/369, 385; D21/83, 114

[56] References Cited

U.S. PATENT DOCUMENTS

| | | | |
|---|---|---|---|
| D. 256,929 | 9/1980 | Caranica et al. | D21/114 |
| D. 268,201 | 3/1983 | McElhaney | D21/114 |
| 2,252,077 | 8/1941 | Katz | 446/369 |
| 2,455,887 | 12/1948 | Braude | 446/7 |
| 2,591,379 | 4/1952 | Schradermeier | 446/72 |
| 2,618,892 | 11/1952 | Locks et al. | 446/268 |
| 2,994,153 | 8/1961 | Zwolinski | 446/7 |
| 3,085,610 | 4/1963 | Vardan | 446/227 X |
| 3,120,716 | 2/1964 | Orenstein | 446/7 |
| 3,238,599 | 3/1966 | Bauman | 446/369 X |
| 3,659,375 | 5/1972 | Stubmann | 446/7 |
| 4,076,006 | 2/1978 | Breslow et al. | 446/212 X |
| 4,208,831 | 1/1980 | Strauss | 446/7 |
| 4,292,758 | 10/1981 | Kuna et al. | 446/7 |
| 4,540,219 | 9/1985 | Klinger | 446/227 X |

FOREIGN PATENT DOCUMENTS

| | | | |
|---|---|---|---|
| 559067 | 6/1958 | Canada | 446/7 |

OTHER PUBLICATIONS

Playthings, Mar. 1964, 62 #3, p. 299–advertisement by Kohner Bros Inc.

*Primary Examiner*—Robert A. Hafer
*Assistant Examiner*—D. Neal Muir
*Attorney, Agent, or Firm*—Ronald M. Goldman; Melvin A. Klein; Daniel F. Sullivan

[57] ABSTRACT

An infant's toy (20) is disclosed as being made from soft, spongy members fixed together so as to form a simulated dashboard, or the like, of an automobile. The toy includes a soft steering wheel (26), an opening and closing simulated glove compartment (48) with its own toy (58) contained therein, and held by a cord (62) to prevent loss. A pocket (38) containing keys (40) or the like is also fixed to the toy. A further cord (41) prevents loss of the keys. A soft moveable gear shift lever (30) and soft operable radio (42) are also fixed to the simulated dashboard. Soft washable fabric (24) covers the elements of the toy, and the overall configuration and make up prevents harm or damage if a child strikes the toy, or is struck by the toy.

6 Claims, 13 Drawing Figures

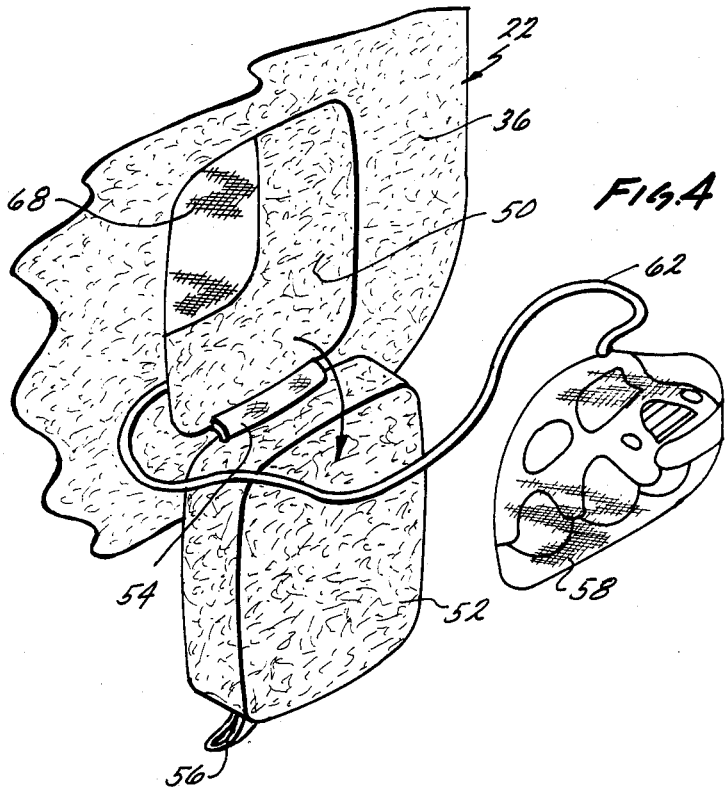
FIG. 4
FIG. 7
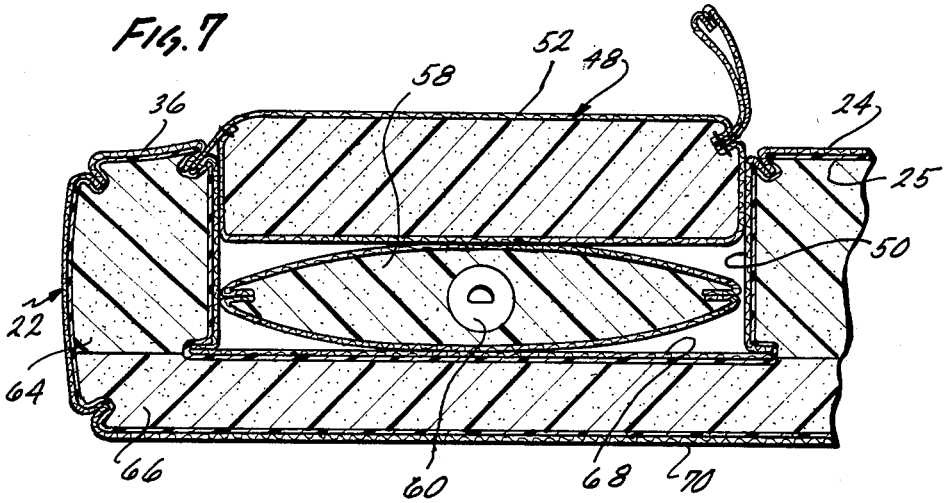

INFANT'S SOFT, SIMULATED AUTO DASHBOARD

CROSS-REFERENCE TO RELATED APPLICATION

This application is a continuation-in-part application of pending design application Ser. No. 581,939, filed Feb. 21, 1984, and assigned to the assignee of the instant invention.

TECHNICAL FIELD

This invention relates generally to infant toys and more particularly to a safe infant's toy made from soft, spongy materials, and which may be attached to any article to be played with by an infant.

BACKGROUND ART

There are many diverse type of infant toys and devices, such as busy boxes played with by children to simulate the driving of a vehicle. One such device is shown in U.S. Pat. No. 2,994,153, and discloses a simulated vehicle control device for attaching to the rear of the front seat of an automobile. Another such device is shown in U.S. Pat. No. 3,659,375, and discloses a number of parts in operative relation simulating some of the controls of an automobile, such as the windshield, windshield wiper, etc.

However, as shown and disclosed in these patents, these simulated toys or busy boxes are composed of hard plastics or other hard materials which could endanger and/or damage a child or other person propelled into the toy. That is, if an infant was to stumble, or was throuwn into such devices during the quick stopping of a vehicle, the infant could be hurt by hard protuberances on the device.

Therefore, there exists the need for an infant's toy which can be utilized by the infant to simulate the driving activities of a parent or other individual, and which is soft and compliant to provide safety and other related features.

DISCLOSURE OF THE INVENTION

In one aspect of the present invention, there is provided an infant's toy made from soft, spongy members fixed together so as to form a simulated dashboard of an automobile. The toy includes a soft dashboard member, a soft steering wheel, an opening and closing simulated glove compartment with its own playing member contained therein and a cord securing the playing member to the compartment. A pocket containing keys or the like is also fixed to the toy. A further cord prevents loss of the keys. In addition, a soft moveable gear shift lever and soft simulated radio are fixed to the soft dashboard member. Soft washable fabric covers the elements of the toy.

As a consequence of the soft, spongy construction of the infant's toy of the present invention, there is provided a completely safe and soft toy which may be used alone or may be attached to a playpin, stroller, crib, car seat or other article, and which provides added safety features not known by presently existing devices.

DESCRIPTION OF THE DRAWINGS

FIG. 4 is an enlarged, partial perspective view showing the simulated glove compartment with the door open and the simulated toy rattle thereof in position out of the compartment;

FIG. 7 is a partial sectional view through the simulated glove compartment taken along line 7—7 of FIG. 1;

BEST MODE FOR CARRYING OUT THE INVENTION

Figure 9:
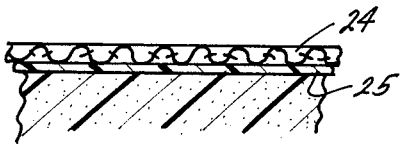
FIG. 9 is an enlarged partial sectional view taken along line 9—9 of FIG. 6.

Turning to the accompanying drawings in which like reference characters refer to like elements in the several view, FIGS. 1, 5, 12 and 13 show a preferred embodiment of the infant's toy 20 of the present invention. The toy includes a main body or member 22 made from a soft, spongy material such as foam rubber, or the like. A soft washable covering material 24 such as terry cloth is used to entirely encase the foam rubber material within the body 22, as well as to cover the other parts of the toy, as described more fully hereinafter. In addition, as shown more clearly in FIG. 9, a thin coating of plastic 25 preferably covers the foam rubber parts under the covering material 24 to prevent moisture from penetrating into the foam.

The toy 20 may take any desired configuration, but in the preferred embodiment shown is a completely soft toy made in the shape of a simulated dashboard of a car. The toy includes a simulated steering wheel 26 comprised of a soft spongy material, also covered by the cloth covering 24 and plastic 25, and may also include a decal 28 or the like affixed, printed or embroidered on the front thereof. The steering wheel 26 is fixed to the front or upper surface 36 of member 22, as described more fully hereinafter.

The cloth covering acts as a means for fixing members to the toy. A simulated gear shift knob 30, also made of soft spongy material covered by cloth and plastic, and including a back loop 32, sewn or affixed to the cloth material 24 covering the ball, is fixed to the upper surface 36 of the covering material 24. The knob is preferably slidably held to a slider 34 by the loop 32, while the slider is fixed to the front or upper surface 36 at the ends thereof, in any convenient manner, as by gluing or sewing. Identifying indicia, such as the P, N, D and R for park, neutral, drive or reverse of an automatic drive automobile, or the numbers of the gears of a manual shift transmission may be printed on surface 36, or a separate patch 37 may be fixed to material 24 and the slider 34 fixed to the patch 37.

Figure 1:
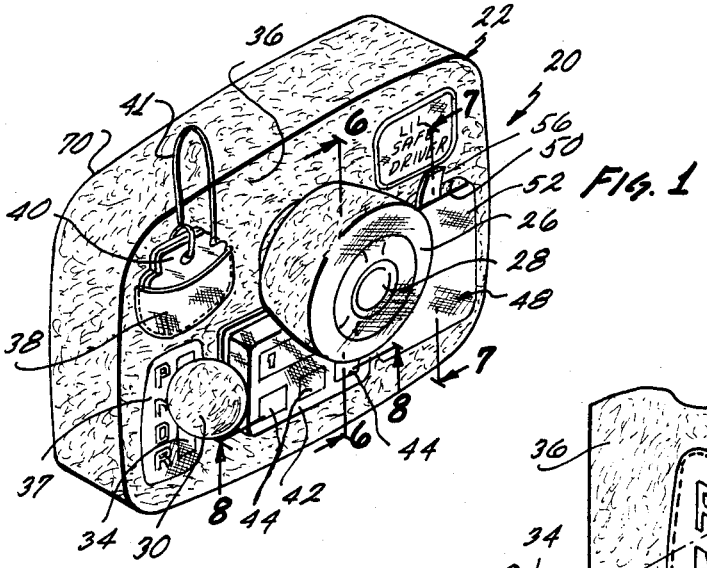
FIG. 1 is a perspective view of a preferred embodiment of the infant's toy of the present invention.
Figure 2:
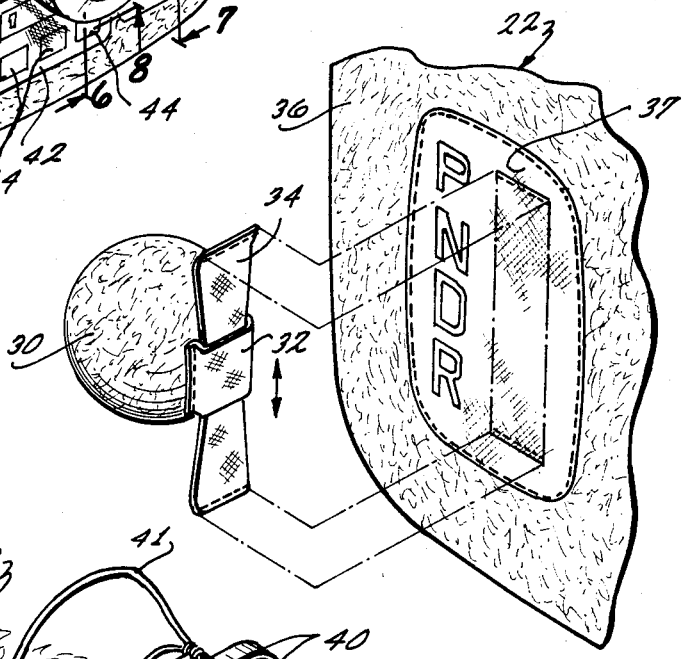
FIG. 2 is an enlarged, exploded partial perspective view showing the gear shift mechanism of the infant's toy of FIG. 1.
Figure 3:
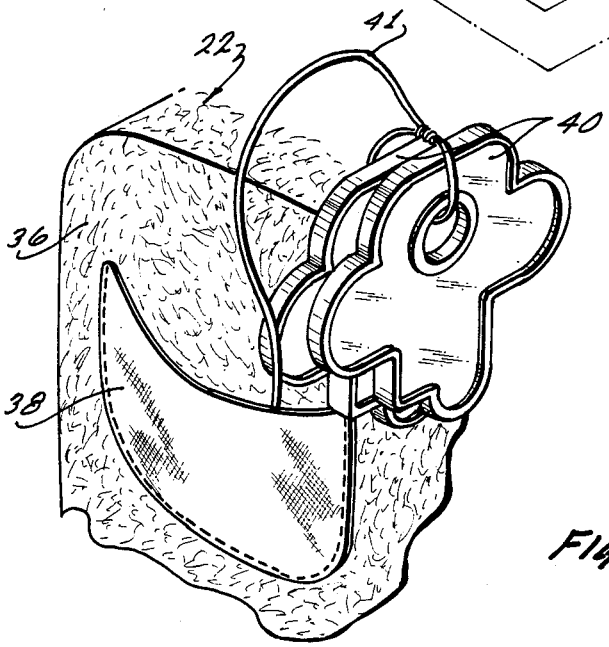
FIG. 3 is an enlarged, partial perspective view showing the pocket and simulated key members of the present invention.

As shown more clearly in FIG. 3, a pocket 38 may be fixed to the upper surface 36. A cord 41 is fixed within the pocket, or to the cloth covering 24, at one end, and has a plurality of a soft, plastic elements 40, shaped as keys or the like, with no sharp edges to harm an infant using the same, at the other end.

The upper surface 36 of cloth material 24 also has affixed thereto a simulated push button radio 42. A plurality of simulated push buttons 44 having separate sqeekers 46 thereunder are provided so that separate sounds may be emited each time one of the push buttons 44 is pushed by an infant.

Finally, a simulated glove box or compartment 48 having an opening 50 therein is provided to one side of the steering wheel 26. A cover 52 formed from soft, spongy material covered with cloth material and plastic is hingedly attached to the upper surface 36 of material 24, by means of a flap, or the like 54 formed of the same cloth material. In addition, a grasping or pulling member 56 is attached to the unhinged end of the cover to enable the cover to be more easily pulled open.

A rattle or other playing member 58, formed from cloth covered soft, spongy material and shaped and sized to fit into the opening 50 of the simulated glove compartment when the cover 52 is in the closed position (FIG. 7), is provided. The playing member 58 may take any desired shape, such as an animal, or toy car and may include a squeeker or rattle 60 therein to amuse a child when playing with the same. A cord 62 is fixed at one end to the toy 58, and at the other end to the covering material within the opening 50.

Figure 5:
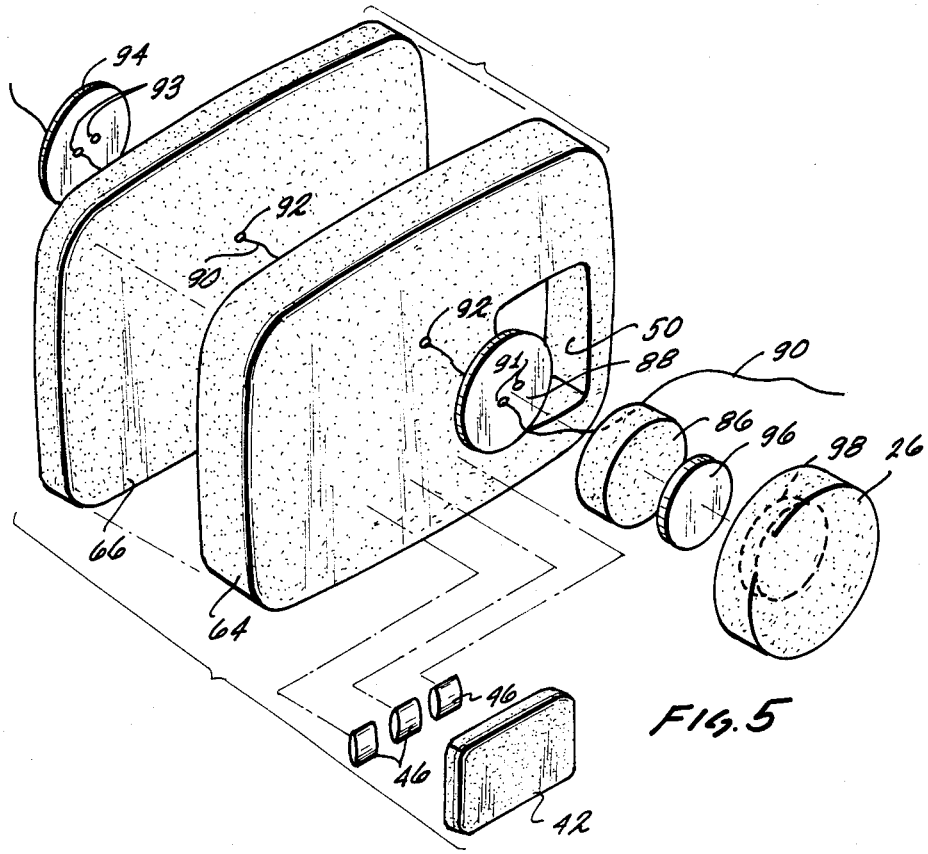
FIG. 5 is an exploded perspective view of the infant's toy of the present invention, with the soft covering removed.

As shown more clearly in FIG. 5, base member 22 is formed from two soft spongy members 64, 66. The opening 50 is formed within the soft, spongy upper member 64, and passes entirely therethrough. A base or bottom 68 for the opening 50 is formed adjacent the surface of rear member 66 when the entire body 22 of toy 20 is covered by material 24.

The infant's toy of the present invention may be used as a floor toy, but is preferrably used, as by attachment to car seats, strollers, high chairs, cribs, playpin or any other article of furniture, where it may be conveniently played with by an infant. In addition, as shown in FIGS. 10 through 13, the rear surface 70 of the infant's toy 20, after being covered with the cloth 24 and plastic material 25 is provided with fixing means, such as belt loops 72, 74, affixed thereto in any convenient manner. Separate straps 76, 78 may be inserted through and held in a variety of different manners and positions in the loop means 72, 74. In particular, each of the straps 76, 78 is provided with non-metallic hook and loop fastening means 80 on opposite sides of the strap at each end thereof. In this manner, the ends of the straps may be fastened together around an article, or the ends of both straps may be fixed to each other and the loose ends thereof wrapped around an article.

Figure 10:
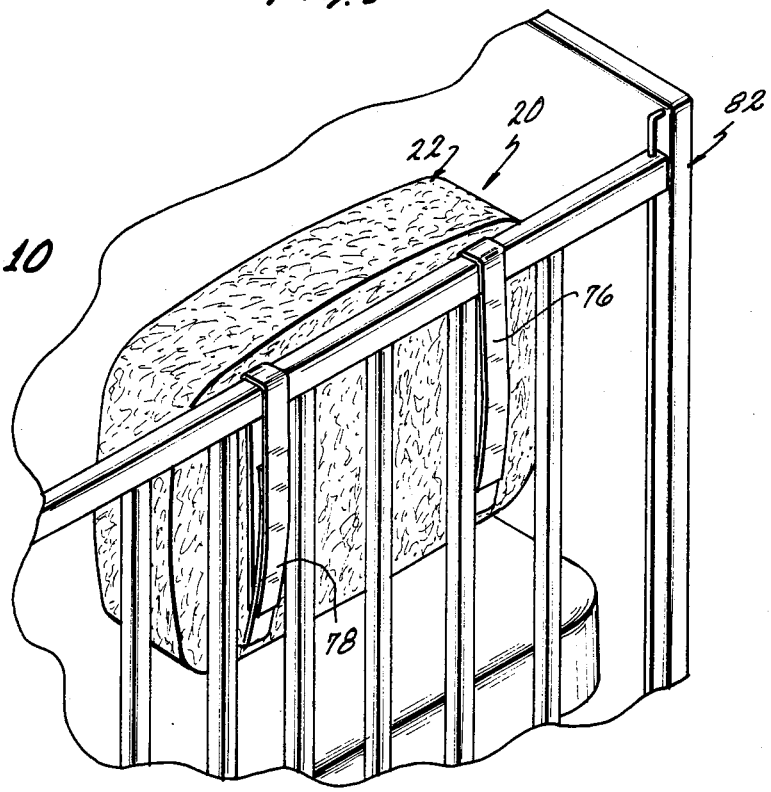
FIG. 10 is a partial perspective view showing the infant's toy of FIG. 1 mounted on a crib rail.
Figure 11:
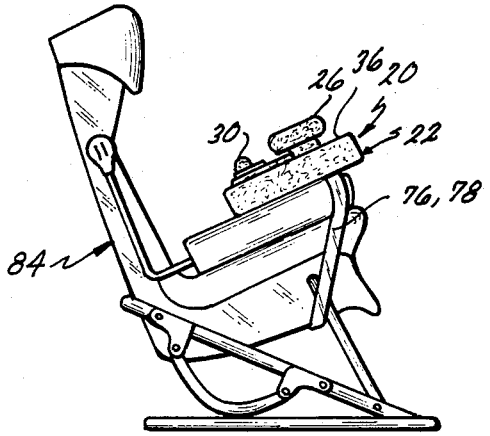
FIG. 11 is a side elevational view showing the infant's toy of FIG. 1 mounted on an infant's car seat.
Figure 12:
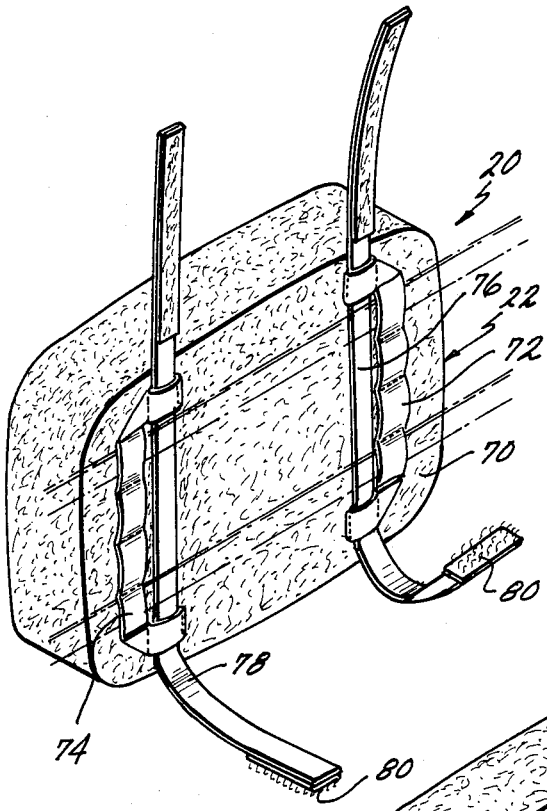
FIG. 12 is a perspective view of the back of the infant's toy shown in FIG. 1, with strap holding means shown in various positions.
Figure 13:
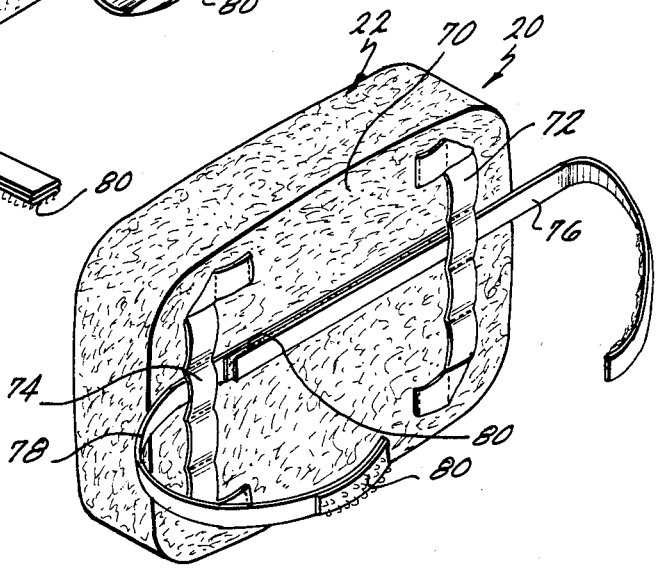
FIG. 13 is a further perspective view of the back of the infant's toy shown in FIG. 12, with the straps fixed together at one end, and passing through a pair of loops in the horizontal position so as to enable the infant's toy to be attached to a car seat or the like, as illustrated in FIG. 11.

As shown in FIG. 10 and 12, the straps 76, 78 may be run through aligned pairs of vertically extending loops formed in the belt loop means 72 and 74, and placed over the edge rail of a crib 82, or similar article of furniture. Or, as shown in FIGS. 11 and 13. the straps may be fixed together so as to form a longer single strap and placed through any of the plurality of aligned horizontal loops formed in the loop means 72, 74 and attached to a car seat or the like 84.

The use of the plastic material 25 surrounding the soft, spongy inner members, with the soft cloth covering material 24 over the plastic, allows the exterior surface of cloth covering material to be washed or sponged off, without water entering into the soft spongy inner members.

Figure 8:
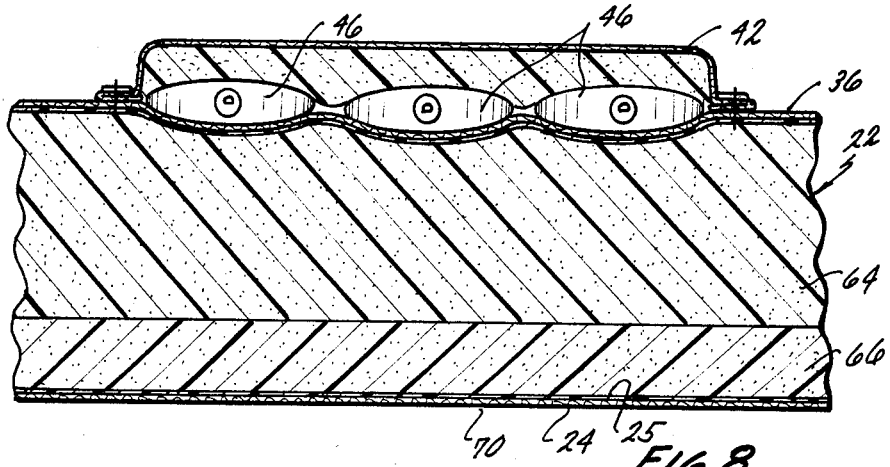
FIG. 8 is a partial sectional view through the simulated radio taken along line 8—8 of FIG. 1.

Turning back to FIGS. 5, 6 and 8 of the drawings, there shown are preferred means for fixing the steering wheel and radio to the front or upper surface 36. The radio 42 (FIG. 8) is preferably formed from a single piece of soft spongy material held to or fixed over the cloth covering 24, with a plurality of squeekers 46 aligned with the simulated push buttons 44 printed or formed on a smaller piece of material 24 covering the single piece of soft spongy material. The smaller piece of material is fixed to the larger piece of material 24 on the upper surface 36 in any convenient manner, as by gluing or sewing.

Figure 6:
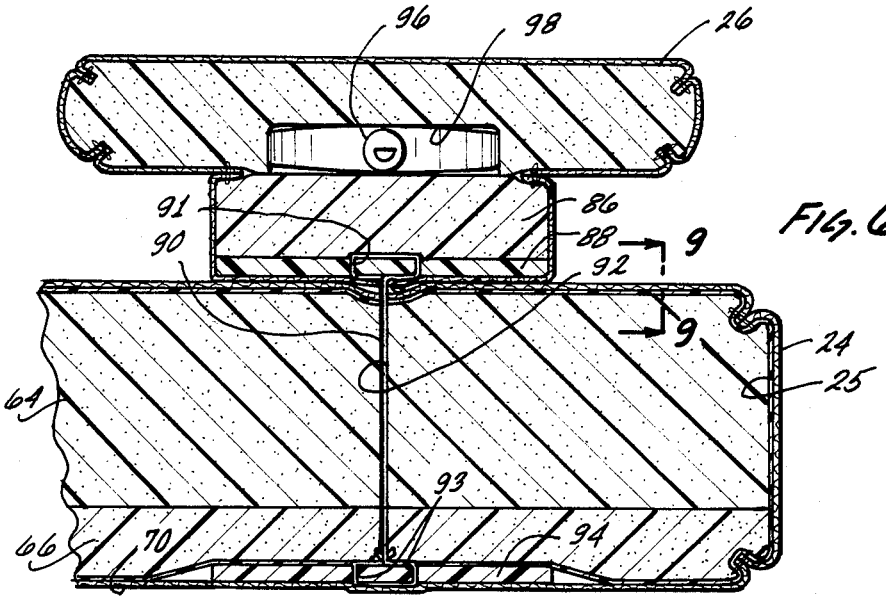
FIG. 6 is a partial sectional view through the simulated steering wheel taken along line 6—6 of FIG. 1.

As shown in FIGS. 5 and 6, the steering wheel 26 is rotatably mounted to the body 22 by a lower portion 86, also formed of the same soft, spongy material. Lower portion 86 is fixed directly to the wheel, or held to the wheel by the surrounding cloth covering 24. A squeeker 96 is held within an opening 98 formed entirely in the wheel, or between the base of the wheel 26 and the lower portion 86. In addition, a button-like member 88, formed of a soft, flexible plastic is held by the covering material 24 within and adjacent to the lower surface of member 86. A resilient cord 90 is threaded through a plurality of holes 91 formed within the button member 88 and is tied or fixed thereto. The cord 90 is then threaded or passed through a narrow opening 92 formed through the covering material 24 over the body 22, front sponge member 64 and backing sponge 66. The cord 90 is then laced through and tied in a purality of holes 93 formed within a further soft plastic button member 94. The button 94 is also enclosed in or held by the covering material 24 against the back or lower surface of the rear or lower member 66. In this manner, a safe but reliable means for allowing the steering wheel 26, to be turned with respect to the toy is provided.

It therefore can be seen that a safe, completely soft infant's toy for use by infant's when traveling, or in other conditions of play is disclosed. The toy has numerous play features to occupy the infant, some of which move and others of which rattle or squeek. These features will help entertain an infant using the same without distracting other persons. In addition, the sliding gear shift knob and rotatable steering wheel add further play value. The steering wheel may contain a horn or squeeker 96 to provide still further entertainment.

Finally, soft cloth, sponge rubber or plastic members, in any desired shape, such as keys, animals, vehicles, or the like, are attached by cords to the toy and fit within their own special pockets, or within simulated glove compartments, having an opening door. The cords prevent loss of the members or rattles.

Furthermore, since all of the protruding parts, such as the steering wheel, gear shift lever and radio are formed from soft, spongy material covered with soft cloth, if a child is propelled or somehow bumps into the toy, no damage to the child will occur. Therefore, the toy can be considered safe while being played with in substantially all circumstances.

While the particular infant's toy shown and described in detail herein is fully capable of attaining the objects and providing the advantages above stated, it is to be understood that it is merely illustrative of the presently preferred embodiment of the invention. No limitations are intended in the details of the construction, design or materials shown, other than as defined in the attached claims, which form a part of this disclosure.

The term "means", as employed in the claims is to be interpreted as defining the corresponding materials or structure illustrated and described in the specification or the equivalent thereof.

While the invention has been particularly shown and described in reference to preferred embodiments thereof, it will be understood by those skilled in the art that changes in form and details may be made therein without departing from the spirit and scope of the invention.

I claim:

1. An infant's toy comprising:

a first soft, spongy member having a lower surface, an upper surface and a cavity provided in said member, said cavity extending from said upper surface to a position above said lower surface for simulating the glove compartment in an automobile;

a coating of plastic material covering said first soft, spongy member;

a first soft fabric cover encasing said first soft, spongy member and said coating of plastic material, said first cover being provided with an opening communicating with said simulated glove compartment;

a second soft, spongy member for closing said cavity;

a second soft fabric cover encasing said second soft spongy member, said second cover having one end which is swingably affixed to said first cover adjacent said opening in said first cover for swinging said second member from open to closed positions with respect to said simulated glove compartment;

a third soft, spongy member, said third member being shaped and sized to fit into said simulated glove compartment;

a first cord having one end affixed to said third member and another end affixed to said first cover adjacent said simulated glove compartment;

a fourth soft, spongy member, said fourth member being circular in shape to simulate a steering wheel, said fourth member including means for rotatably connecting said fourth member to said first member adjacent said first cover on said upper surface of said first member;

a fifth soft, spongy member for simulating an automotive radio, said fifth member including means for affixing said fifth member to said first cover adjacent said upper surface of said first member;

a sixth soft, spongy member shaped to simulate a gear shift knob, said sixth member including means for slidably connecting said sixth member to said first cover adjacent said upper surface of said first member;

a fabric pocket affixed to said first cover adjacent said upper surface of said first member, said pocket having an opening provided therein;

a second cord having one end affixed to said first cover adjacent the opening in said pocket; and at least one element affixed to the other end of said second cord, said at least one element being sized and shaped so that it may be stored in and retrieved from said pocket.

2. An infant's toy as described in claim 1 further comprising:

a plurality of belt loops affixed to said first cover adjacent said lower surface of said first member; and at least one belt for engaging said belt loops to connect said toy to another article.

3. An infant's toy comprising:

first resilient member means for simulating an automobile dashboard and providing first soft, spongy member means for preventing injury to an infant, said first resilient member means having an upper surface, a lower surface and a cavity extending from said upper surface to a position above said lower surface;

a first soft cover encasing said first resilient member means;

a coating of liquid impermeable material covering said first resilient member means, said coating being disposed between said first resilient member means and said first soft cover;

second resilient member means for simulating an automobile steering wheel and providing second soft, spongy member means for preventing injury to said infant, said second resilient member means being rotatably coupled to said first resilient member means adjacent said upper surface;

a second soft cover encasing said second resilient member means;

third resilient member means for simulating an automobile gear shift and providing third soft, spongy member means for preventing injury to said infant, said third resilient member means being coupled to said first soft cover adjacent said upper surface;

a third soft cover encasing said third resilient member means;

fourth resilient member means for removably closing said cavity and providing fourth soft, spongy member means for preventing injury to said infant, said fourth resilient member means being swingably coupled to said first soft cover adjacent said cavity and shaped to engage said cavity; and fifth resilient member means for simulating an automobile radio and providing fifth soft, spongy member means for preventing injury to said infant, said fifth resilient member means being attached to said first soft cover adjacent said upper surface.

4. An infant's toy as recited in claim 3 further comprising means for attaching said toy to another article.

5. An infant's toy as recited in claim 4 further comprising (a) a fabric pocket affixed to said first soft cover adjacent said upper surface and at least one element sized and shaped to be stored in and retrieved from said pocket, each of said at least one element being attached to said fabric pocket by a cord , and (b) a resilient member shaped and sized to fit inside said cavity, said resilient member being attached to said first soft cover adjacent said cavity by another cord.

6. An infant's toy as recited in claim 5 wherein said third resilient member means includes a simulated gear shift knob slidably coupled to a strip of material attached to said first soft cover, said knob being made out of soft, spongy material.

* * * * *